US008286613B2

(12) United States Patent
Millet et al.

(10) Patent No.: US 8,286,613 B2
(45) Date of Patent: Oct. 16, 2012

(54) NOZZLE ASSEMBLY A FUEL INJECTOR AND AN INTERNAL COMBUSTION ENGINE COMPRISING SUCH AN INJECTOR

(75) Inventors: Guillaume Millet, Luzinay (FR); Nicolas Dronniou, Versailles (FR)

(73) Assignee: Renault Trucks, St. Priest (FR)

( * ) Notice: Subject to any disclaimer, the term of this patent is extended or adjusted under 35 U.S.C. 154(b) by 498 days.

(21) Appl. No.: 12/305,791

(22) PCT Filed: Jul. 4, 2006

(86) PCT No.: PCT/IB2006/002885

§ 371 (c)(1), (2), (4) Date: Apr. 6, 2010

(87) PCT Pub. No.: WO2008/004019

PCT Pub. Date: Jan. 10, 2008

(65) Prior Publication Data

US 2010/0229832 A1 Sep. 16, 2010

(51) Int. Cl.
*F02M 51/00* (2006.01)

(52) U.S. Cl. ..... 123/490; 123/495; 239/585.1; 361/154

(58) Field of Classification Search ..... 123/446, 123/490, 495, 499, 507, 508; 239/533.2, 239/585.1, 96; 361/154, 155

See application file for complete search history.

(56) References Cited

U.S. PATENT DOCUMENTS

| | | | | |
|---|---|---|---|---|
| 5,671,715 | A * | 9/1997 | Tsuzuki | 123/467 |
| 7,284,712 | B2 * | 10/2007 | Funai et al. | 239/533.1 |
| 2003/0038185 | A1 | 2/2003 | Carrol et al. | |
| 2004/0055562 | A1 | 3/2004 | Stewart et al. | |
| 2006/0060673 | A1 | 3/2006 | Mack et al. | |

FOREIGN PATENT DOCUMENTS

| | | | |
|---|---|---|---|
| DE | 3824467 | A1 | 1/1990 |
| EP | 1435453 | A1 | 7/2004 |
| EP | 1630406 | A | 3/2006 |

OTHER PUBLICATIONS

International Search Report for corresponding International Application PCT/IB2006/002885.

* cited by examiner

*Primary Examiner* — John Kwon
(74) *Attorney, Agent, or Firm* — WRB-IP LLP

(57) ABSTRACT

A nozzle assembly includes a first needle and a second needle controlling respectively fuel flow towards a first series of outlets and a second series of outlets. It includes a passive control valve adapted to select, on the basis of the fuel feeding pressure, the needle to be activated for fuel delivery to the combustion chamber of an internal combustion engine. An injector with such an assembly is economic and efficient to spray fuel with two different patterns.

19 Claims, 7 Drawing Sheets

NOZZLE ASSEMBLY A FUEL INJECTOR AND AN INTERNAL COMBUSTION ENGINE COMPRISING SUCH AN INJECTOR

BACKGROUND AND SUMMARY

This invention concerns a nozzle assembly, a fuel injector including such an assembly and an internal combustion engine comprising such an injector.

In the field of fuel injection for internal combustion engines, new developments are largely driven by new coming emission regulations, as well as noise and fuel consumption targets. A potential way to improve combustion is to start fuel injection long before the piston reaches its top dead end position (TDC). In some instances, some fuel can be injected up to 180° before TDC. For such an early injection, the spray angle should be small in order to avoid spraying fuel on the cylinder walls, since this would have major drawbacks on emissions, oil dilution and cylinder liners wear. On the contrary, when injection takes place just for TDC, the spray angle should be large in order to suit diesel piston bowls. In order to obtain two spray angles, some nozzles are provided with telescopic needles adapted to feed of two rows of holes or outlets.

In FR-A-2 854 661, a telescopic needle allows a double stage injection with a first spray having a narrow angle and then a mixture of two sprays. In U.S. Pat. No. B-6,557,776, another telescopic needle is used to obtain a first spray through a first row of holes, for small quantities of fuel, and a second spray through two series of holes available, for the main injection. In these systems, the second spray includes a flow corresponding to the first spray. In other words, the second spray is a combination of the first spray and another spray, because prior art systems do not allow the selection of two different rows of holes or orifices. It is only possible to inject fuel either with the first row of holes or with both rows of holes, but not with the second row of holes alone. Moreover, the prior art devices imply complex designs with several actuators, which decreases the reliability of these systems and increases their costs.

U.S. Pat. No. B-6,769,635 discloses a fuel injector whose nozzle assembly includes two rows of holes which can be fed independently from each other thanks to two electrical actuators powered and driven according to the needs. This fuel injector is quite complex to manufacture, expensive and difficult to set.

It is desirable to provide a nozzle assembly which allows to obtain two different spray geometries thanks to two sets of orifices used independently from each other, without needing complex and expensive valves to define which type of orifices is used for spraying fuel within a combustion chamber.

With this respect, the invention concerns a nozzle assembly for injecting fuel into a combustion chamber of an engine, this assembly comprising a first needle and a second needle controlling respectively fuel flow towards a first series of outlets and a second series of outlets. This nozzle includes a passive control valve adapted to select, on the basis of the fuel feeding pressure, the needle to be activated for fuel delivery to the combustion chamber.

Thanks to an aspect of the invention, the passive control valve enables to select which flow path can be open and which series of outlets can be fed when fuel is to be delivered to the combustion chamber.

According to advantageous aspects of the invention, such a nozzle assembly may incorporate one or several of the following features:

- the passive control valve is driven with fuel coming from a source of fuel under pressure and controls flow of fuel coming from two back-pressure chambers acting on the needles.
- the passive control valve is adapted to selectively connect, depending on the pressure level of the driving fuel coming from the source of fuel under pressure, either of the back-pressure chambers with a discharge line.
- the assembly includes a solenoid valve adapted to pilot one of the needle, depending on the selection made by the passive control valve.
- the solenoid valve controls the connection between the discharge line and a low pressure circuit.
- two fuel paths are defined between a source of fuel under pressure and the passive control valve, each path including a back-pressure chamber acting on one of the needles.
- each fluid path includes at least two throttles located respectively upstream and downstream of the corresponding back-pressure chamber.
- the throttles are made in at least a part mounted on a body of said assembly which surrounds the needles.
- one throttle is located between the source of fuel under pressure and each back-pressure chamber.
- a dedicated throttle is located on the entry line of each back-pressure chamber.
- a throttle is located on a feeding line common to both back-pressure chambers.
- one throttle is located between each back-pressure chamber and the passive control valve.
- one throttle is located downstream of the passive control valve.
- the outlets series include a first series of outlets distributed around a central axis with a frustroconical configuration having a first angle and a second series of outlets coaxial with the first series, with a frustroconical configuration having a second angle whose value is superior to the value of the first angle.
- the assembly comprises two back-pressure chambers, each back-pressure chamber acting on one needle.
- the back-pressure chambers and the needles are coaxial.
- the passive control valve comprises a valve core movable in translation within a valve body and subject, on one side, to the action of the fuel feeding pressure and, on the other hand, to the action of elastic return means.

An aspect of the invention also concerns a fuel injector comprising a nozzle assembly as mentioned here-above. Such a nozzle assembly is more flexible to provide fuel to a combustion chamber.

Finally, an aspect of the invention also concerns an internal combustion engine comprising at least a cylinder provided with a fuel injector as mentioned here-above. Such an engine offers more possibilities for performance development and opens the door to further potential improvements.

BRIEF DESCRIPTION OF THE DRAWINGS

The invention will be better understood on the basis of the following description which is given in relation to the annexed drawings, as a non-limiting example. In the drawings.

DETAILED DESCRIPTION OF SOME EMBODIMENTS

Figure 1:
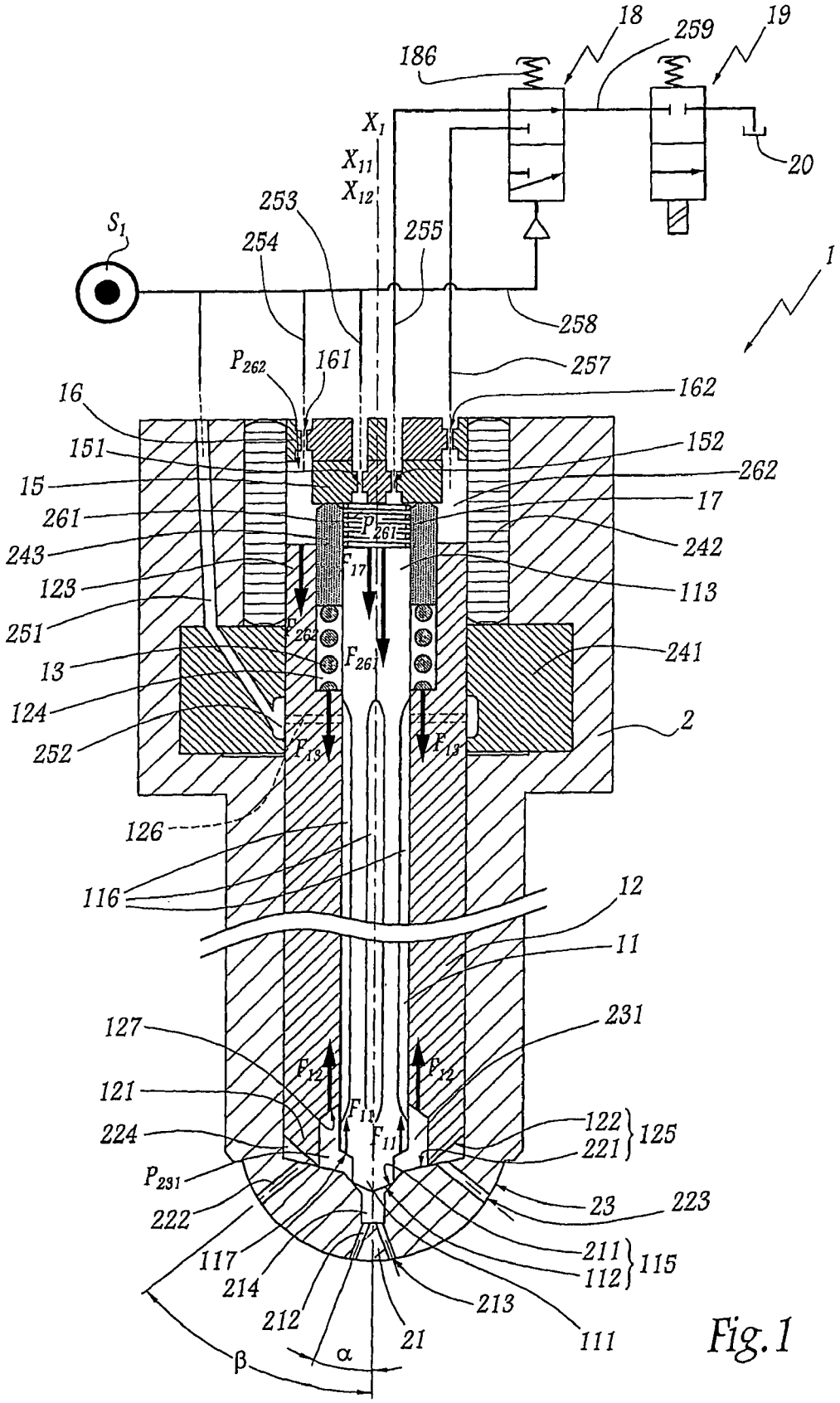
FIG. 1 is a schematic view of a nozzle assembly according to a first embodiment of the invention.

The nozzle assembly 1 of FIGS. 1 to 3, 5 and 6 is supposed to be fed from a source $S_1$ of fuel under pressure which can be an external unit pump, an injector built in pump, an amplification stage of an amplified common rail or a higher stage of any hybrid injector stage providing fuel under pressure at different level during injection. The pressure of the fuel fed to assembly 1 varies as a function of time, as shown on FIG. 4A. More precisely, this pressure varies between a first value $P_1$, which is lower than a reference value $P_{ref}$, and a second value $P_2$ which is higher than $P_{ref}$. The injection pressure P of fuel in nozzle 1 is higher than $P_{ref}$ between instant to and instant $t'_o$.

As an example, $P_{re}f$ might have a value of 1000 bar, whereas Pi is between 300 and 800 bar and $P_2$ is between 1200 and 2000 bar.

Nozzle assembly 1 comprises a main body 2. This body is centered on a longitudinal axis Xi of assembly 1 and includes a first needle 11 which is cylindrical and centered onto its longitudinal axis Xn which is aligned with axis $X_1$. A second needle 12 is also located within body 2. It has a sleeve like shape and is centered on a longitudinal axis $X_{12}$ which is aligned with axes Xi and Xn. Needles 11 and 12 are coaxial and needle 12 surrounds needle 11.

The tip 111 of needle 11 has a conical front surface 112 adapted to lie against a seat formed by a frustroconical surface 211 of body 2 centered on axis X-i. A set of several canals 212 is formed around the central extremity 21 of body 2, these canals being regularly distributed around axis $X_1$ and forming all the same angle α with respect to axis $X_1$. One notes 213 the outlets of canals 212.

A distributing chamber 214 is formed in central extremity 21 and all canals 212 depart from this chamber 214.

The annular tip 121 of needle 12 is provided with a front frustroconical external surface 122 adapted to lie against a second frustroconical surface 221 of body 2 which forms a seat for needle 12. A set of canals 222 is distributed around axis Xi, each canal 222 forming with axis Xi and angle β which is larger then α.

One notes 223 the outlets of canals 222 formed on the external surface 23 of extremity 21, as outlets 213.

All canals 222 depart from a chamber 224 formed between needle 12 and body 2.

When needles 11 and 12 lie against their respective seats formed by surfaces 211 and 221, a chamber 231 is formed between tips 111 and 121, this chamber being isolated from chambers 214 and 224, thus from canals 212 and 222.

Needle 12 is guided within body 2 thanks to two rings 241 and 242 located around its back extremity 123.

Extremity 123 is provided with an internal recess 124 where a spring 13 is kept compressed by a ring 243 lying against a throttle part 15 connected to a second throttle part 16 fast within ring 242. Since ring 243 lies against part 15 which lies against part 16, spring 13 can exert onto needle 12 a force $Fi_3$ pushing tip 121 towards seat 221.

Moreover, a second spring 17 is compressed between the back extremity 113 of needle 11 and part 15, so that it exerts on needle 11 a force $Fi_7$ which urges tip 111 towards seat 211.

One can consider that surfaces 112 and 211 form a valve 115 which is either open or closed, depending on the position of tip 111 with respect to surface 211.

Similarly one can consider a second valve 125 formed by surfaces 122 and 221. This valve is either closed or opened, depending on the position of needle 12 with respect to body 2.

Figure 2:
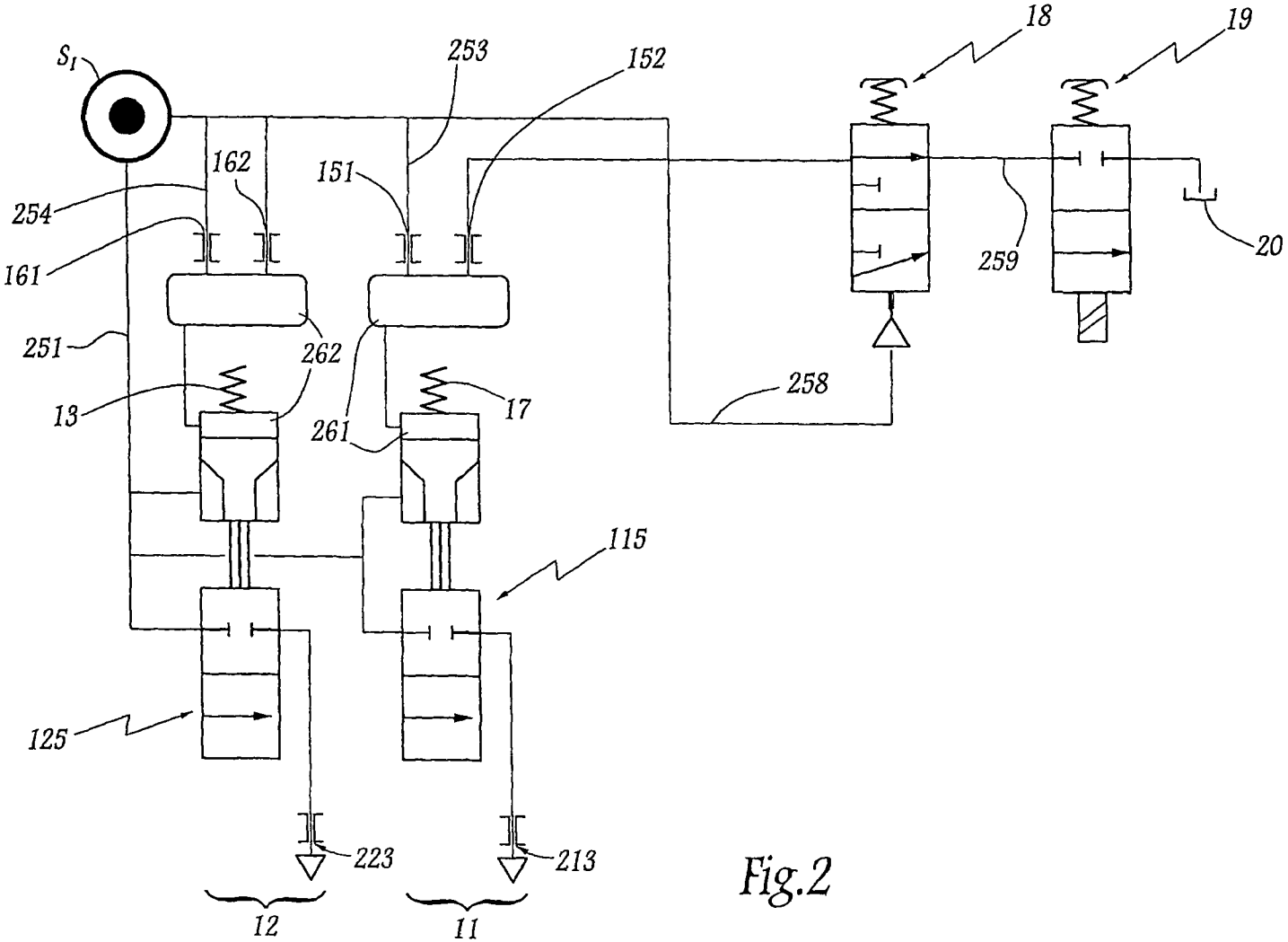
FIG. 2 is a schematic flow chart of the nozzle assembly of FIG. 1.

These two valves 115 and 125 are represented on FIG. 2.

If some fuel is provided to assembly 1 by source Si, fuel flows through a first canal 251 defined by body 2 and ring 241 towards a circular chamber 252 where it feeds radial canals 126 provided within needle 12. These canals feed some longitudinal grooves 116 provided on the radial surface of needle 11, which allows fuel to flow up to chamber 231 where pressure increases as long as needles 11 and 12 remain in the closed position of valves 115 and 125.

Pressure $P_{23}i$ of fuel within chamber 231 acts on a frustroconical surface 117 of needle 11 as a lift force Fn which tends to open valve 115. Pressure 231 also acts on a frustroconical surface 127 of needle 12 as a lift force $F_{12}$ which tends to open valve 125.

Fuel coming from source Si is also fed by two lines 253 and 254 to two backpressure chambers 261 and 262 whose pressures $P_{261}$ and $P_{262}$ act respectively on back extremities 113 and 123. In other words, chambers 261 and 262 act, by their respective pressures, on needles 11 and 12. One notes respectively F261 and $F_2$62 the forces acting on needles 11 and 12 as the result of pressures $P_{261}$ and $P_{262}$.

A first throttle 151 is defined within part 15 in the entry line 253 of fuel within chamber 261. A second throttle 152 is defined within part 15. This throttle is located on an exit line 255 connecting chamber 261 to a passive control valve 18.

Part 16 is also provided with a first throttle 161 and a second throttle 162 provided respectively on the feeding line 254 of chamber 262 and the exit line 257 of this chamber. The cross section of throttle 162 is larger than the cross section of throttle 161.

Chamber 262 is also connected, by exit line 257, to valve 18.

Figure 5:
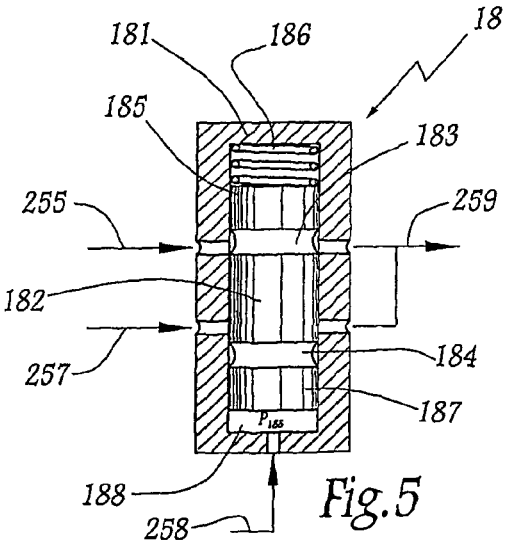
FIG. 5 is a structural view of the passive control valve of the nozzle assembly in the configuration of FIG. 1.

As shown on FIG. 5, valve 18 comprises a valve body 181 within which a valve core 182 is movable in translation along a longitudinal axis $Xi_8$ of body 181. Valve core 182 is provided with two peripheral grooves 183 and 184. Core 182 is loaded, on a first extremity 185, by a spring 186 whereas its second extremity 187 is subjected to the pressure $Pi_{88}$ within a chamber 188 fed by fuel under pressure through a feeding line 258 connected to source Si. In other words, the position of valve core 182 within valve body 181 is controlled thanks to the pressure $Pi_{88}$ within chamber 188. Depending on its value, pressure Piss, which corresponds to pressure P because pressure losses are negligible with respect to the values of fuel pressure, is sufficient or not to push core 182 against the action of spring 186.

The exit or discharge line 259 of valve 18 is connected to a solenoid valve 19 which can either isolate line 259 from a low pressure circuit 20 or connect line 259 to this circuit when it is activated.

Spring 186 is chosen so that when pressure within chamber 188 is lower than $Pr_{ef}$, core 182 is in the position of FIG. 5 so that line 255 is connected to line 259 through groove 183, whereas line 257 is isolated from line 259. On the contrary, when Piss is higher than $P_{ref}$f, line 255 is isolated from line 259, whereas line 257 is connected to line 259 through groove 184, as shown on FIG. 6.

Two parallel flow paths for fuel extend between source Si and valve 18. The first flow path goes through elements 253, 151, 261, 152 and 255. The second flow path goes through elements 254, 161, 262, 162 and 257.

Assembly 1 works as follows: Between t=0 and t=to, fuel is provided to assembly 1 at a pressure P lower than $P_{ref}$. Under such circumstances, valve 18 is in the configuration of FIGS. 1 and 5. Needle 12 is subject to forces $Fi_2$, $F_{13}$ and $F_{262}$ and spring 13 is chosen so that the sum of these forces pushes needle 12 against surface 221, so that valve 125 is closed. This situation remains, irrespective of the actuation of valve 19 because line 257 is not connected to valve 19, so that pressure $P_2$62 remains similar to P-i, with a slight difference due to delay and pressure drop. Since force $Fi_2$ is lower than the sum of forces $F_{13}$ and $F_{262}$, needle 12 remains in its closed position.

Needle 11 is subject to forces Fn, F1$_7$ and $F_{26}$i. Spring 17 is chosen so that, similarly to what happens for needle 12, surface 112 bears against surface 211 as long as force $F_2$61 is kept constant.

One considers that pressure losses in the different canals and lines are negligible with respect to pressure losses due to throttles 151, 152 and equivalent equipments.

Throttle 151 has a smaller cross section than throttle 152.

In the configuration of FIG. 1, if one activates solenoid valve 19, then line 255 is put into communication with low pressure circuit 20 through valves 18 and 19. In other words, fuel present in chamber 261 flows towards the low pressure circuit and, since throttle 152 is larger than throttle 151, pressure within chamber 261 decreases. Spring 17 is chosen so that when pressure $P_{26}$i decreases below a prescribed value, force Fn is sufficient to lift needle 11.

Figure 4A:
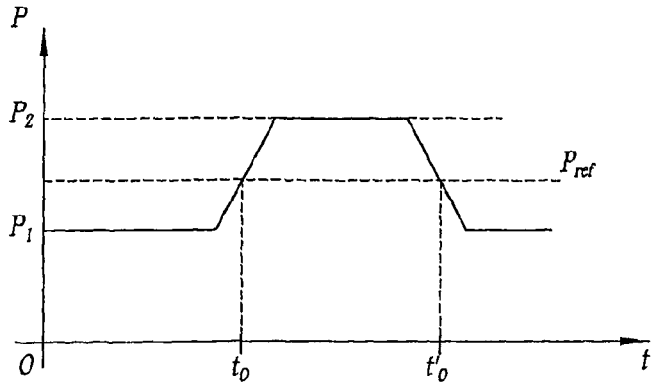
FIG. 4A represents the variation of the fuel injection pressure in the nozzle assembly, as a function of time.
Figure 4B:
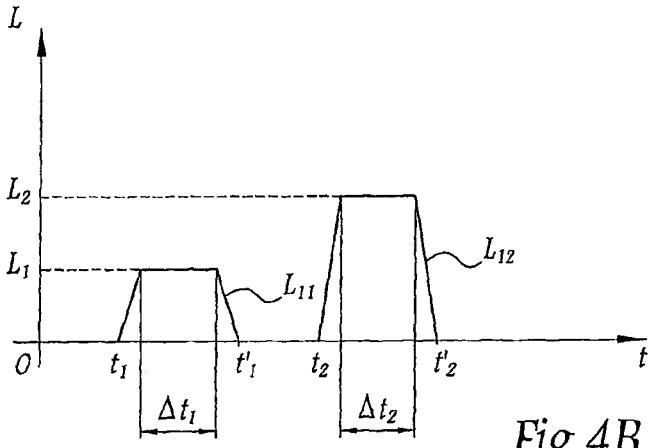
FIG. 4B represents the lifts of the needles of the nozzle assembly, as a function of time.

If one considers that solenoid valve 19 is activated between instants ti and t'i on FIG. 4B, the lift Ln of needle 11 takes a first value $L_1$ for a period of time δt| depending on the actuation of solenoid valve 19, which allows fuel to flow through canals 212 and to exit assembly 11 through outlets 213. This produces a first fuel spray FSi shown on FIG. 7, whose geometry is defined by angle α and the number of canals 212.

Figure 3:
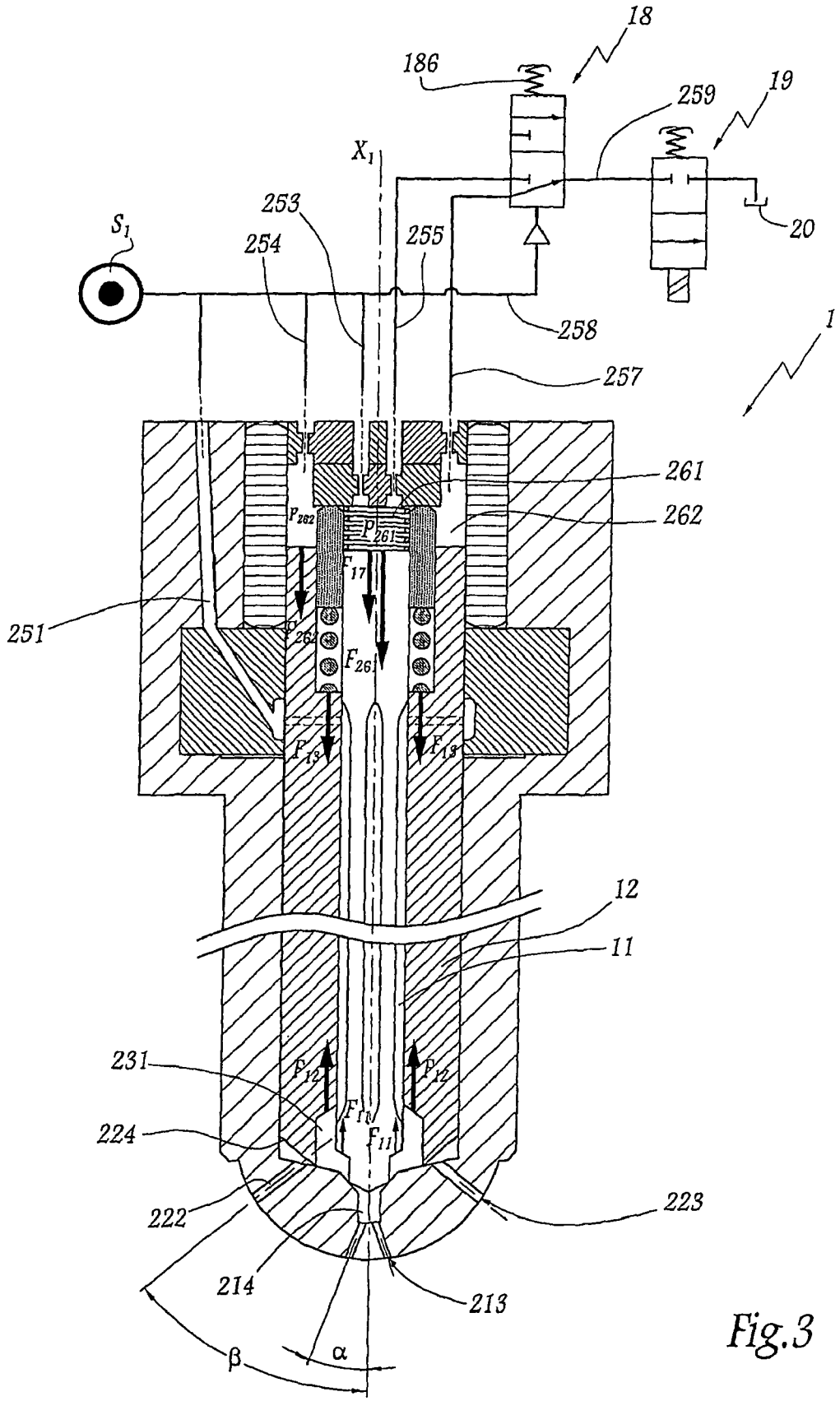
FIG. 3 is a view similar to FIG. 1 when the nozzle assembly is in another configuration of work.
Figure 6:
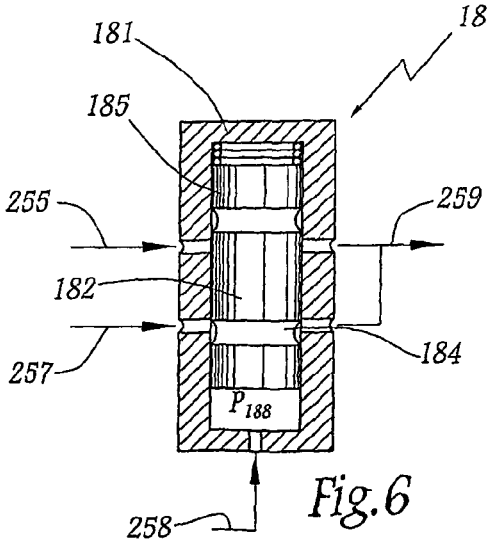
FIG. 6 is a view similar to FIG. 5 when the nozzle assembly is in the configuration of FIG. 3.

When fuel injection pressure P becomes larger than $P_{r\beta f}$ at instant $t_0$, passive control valve 18 switches from the position of FIGS. 1 and 5 to the position of FIGS. 3 and 6, so that exit line 255 is isolated from exit line 259, whereas exit line 257 communicates with exit line 259. Under such conditions, if one activates solenoid valve 19 between instant $t_2$ and instant $t'_2$, chamber 262 is progressively emptied, so that pressure $P_{262}$ progressively decreases in such a manner that force F12 is sufficient to lift needle 12 against forces $F_{13}$ and $F_{262}$.

As shown on FIG. 4B, the lift $L_{32}$ of needle 12 increases progressively up to a predetermined value $L_2$ for a period of time $\delta t_2$ which depends on the actuation of valve 19. Then lift $L_{12}$ decreases back to zero.

When lift $L_{12}$ is non null, fuel can flow from chamber 231 to canals 222 and exit assembly 1 through outlets 223. This produces a second fuel spray $FS_2$ whose geometry is defined by angle β and the number of canals 222.

Thanks to the invention, two different types of outlets 213 and 223 can be used successively without obligation to use both series of outlets for a predetermined period of time. Valve 18 allows to automatically switch from the actuation of needle 11 to the actuation of needle 12 depending on the fuel injection pressure P which varies in a known manner, as a characteristic of source $S_1$.

It is therefore possible to use two independent injection spray patterns $FS_1$ and $FS_2$ defined by angles α and β, the number of canals 212 and 222 and the needle velocity, that is the shape of the lifts Ln and L $i_2$ on FIG. 4B.

Throttles 151 and 152 are made within part 15 and throttle 161 and 162 are made within part 16. These two parts 15 and 16 can be easily changed in order to adapt the geometry of lifts $L_{11}$ and $L_{12}$ to the desired fuel sprays.

According to their respective size, throttles 151 and 152 define the speed at which back-pressure chambers 261 and 262 will see their pressure decrease, when valve 19 opens, or increase again, when valve 19 closes. The variation rate of the pressure will at least partly control the speed at which needles 11 and 12 move with respect to their seats formed by surfaces 211 and 221.

Nozzle assembly 1 is very compact and non sophisticated, insofar as it includes only one electromechanical device, namely solenoid valve 19, the selection of the active needle, 11 or 12, being automatically made by passive valve 18.

Figure 7:
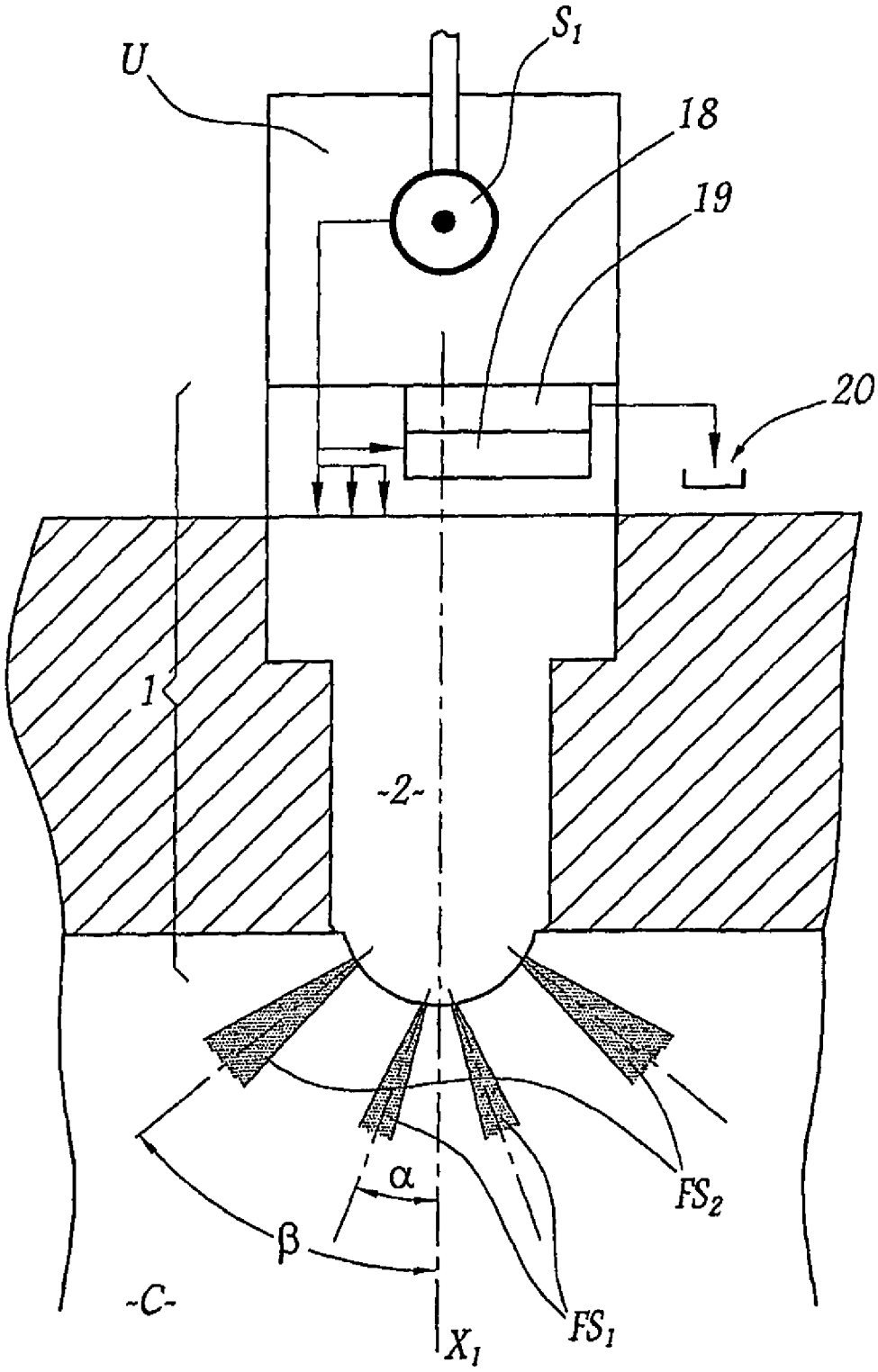
FIG. 7 is a schematic view of a part of an engine incorporating a fuel injector which comprises a nozzle assembly according to FIGS. 1 to 3, 5 and 6.

As shown on FIG. 7, nozzle assembly 1 can be part of a fuel injector I mounted on a cylinder head H of an engine E in order to feed a combustion chamber C of this engine. This injector I can be of the amplified type and include an amplifying unit U comprising a source Si of fuel with two pressure levels. Alternatively, injector I can be fed by any of the devices mentioned here-above.

Figure 8:
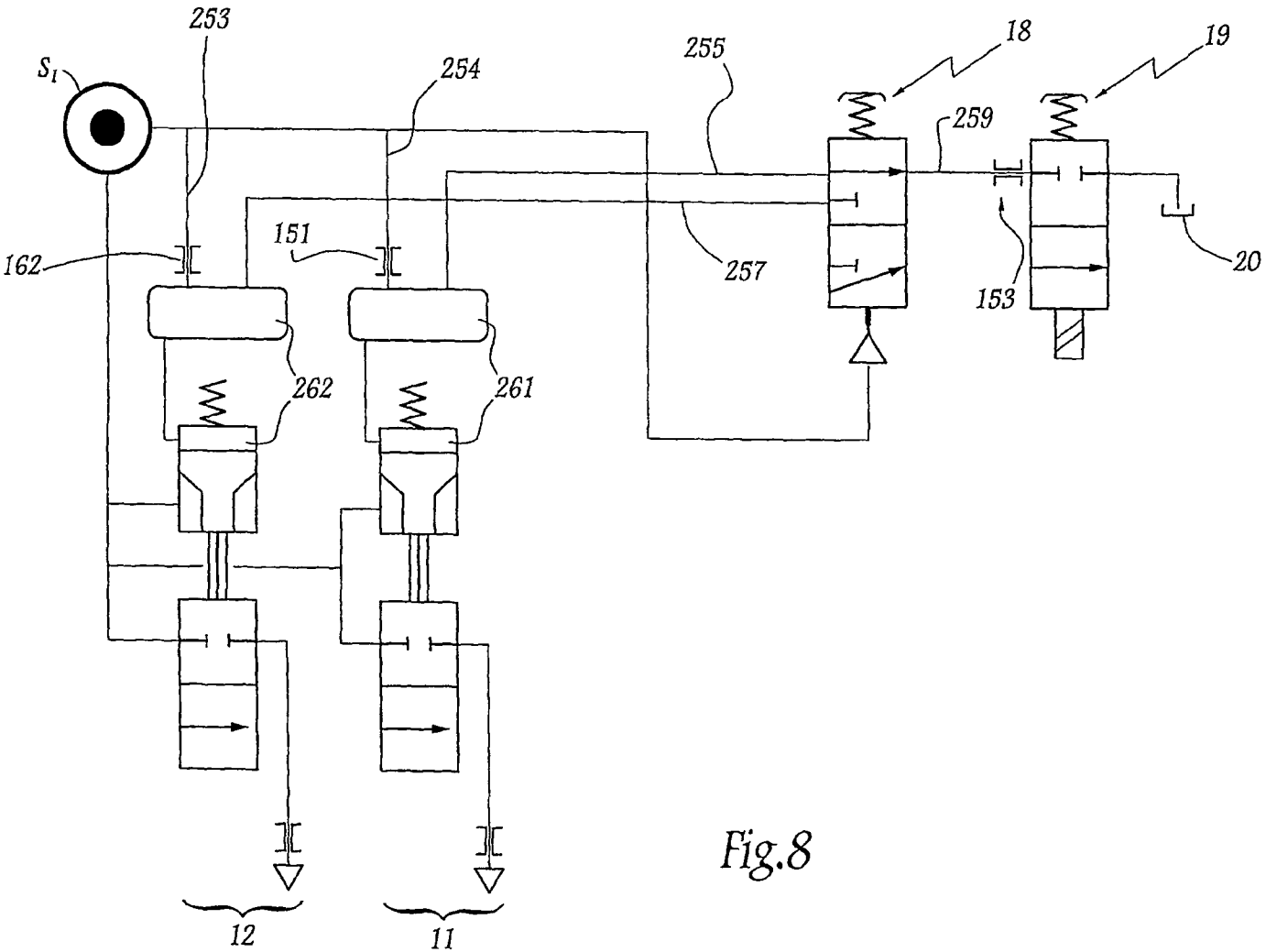
FIG. 8 is a flowchart similar to FIG. 2 for a nozzle assembly according to a second embodiment of the invention.

In the embodiment of FIG. 8, the same elements as in FIG. 2 bear the same references. Here, throttles 152 and 162 of the first embodiment are replaced by a single throttle 153 placed on exit line 259, which allows to control the discharge of chambers 261 and 262 with the same element.

Figure 9:
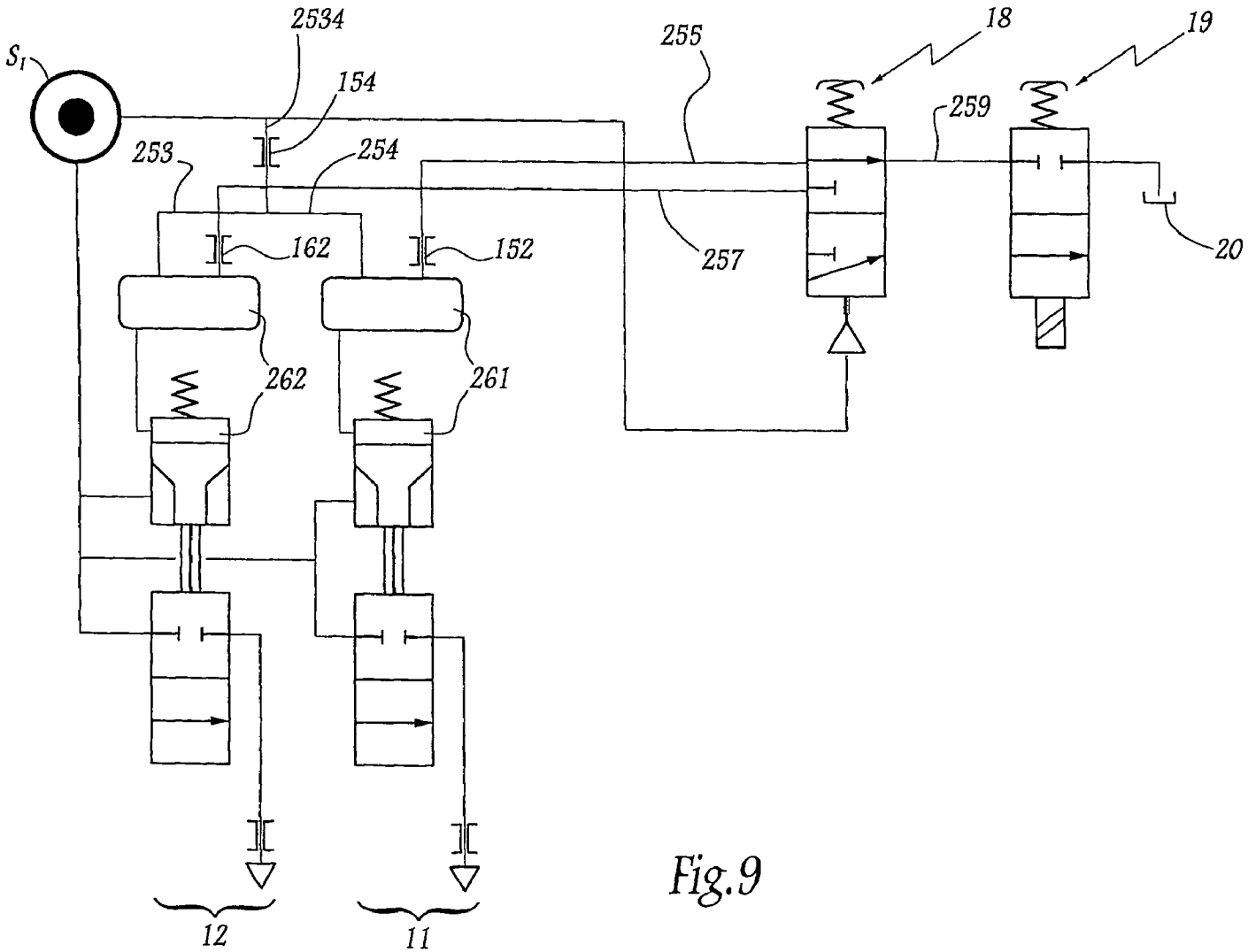
FIG. 9 is a flowchart similar to FIG. 2 for a nozzle assembly according to a third embodiment of the invention.

In the embodiment of FIG. 9, throttle 151 and 161 of the first embodiment are replaced by a single throttle 154 placed on a common portion 2534 of feeding lines 253 and 254.

The invention has been described with a nozzle assembly whose needles have frustroconical bearing surfaces 112 and 122, which allows a good contact with the corresponding seats 211 and 221. However, other geometries of the tips 111 and 121 can be considered.

The path of fuel between canals 126 and chamber 231 has been described as been made by longitudinal grooves on needle 11. Any kind of other convenient designs is suitable, in particular one or several helicoidal grooves on the first needle 11 or on the internal surface of the second needle 12.

LIST OF REFERENCES

1 nozzle assembly
2 main body
21 central extremity
211 frustroconical surface
212 canals
213 outlets
214 chamber
221 frustroconical surface
222 canals
223 outlets
224 chamber external surface of extremity 21
231 chamber
241 ring
242 ring
243 ring
251 canal
252 chamber

253 inlet line
2534 common portion of 253 and 254
254 inlet line
255 exit line
257 exit line
258 feeding line
259 discharge line of valve 18
261 back-pressure chamber
262 back-pressure chamber needle
111 tip
112 front surface
113 back extremity
115 valve
116 grooves
117 frustroconical surface needle
121 tip
122 front surface
123 back extremity
124 recess
125 valve
126 radial canals
127 frustroconical surface
13 spring
15 throttle part
151 throttle
152 throttle
153 throttle
154 throttle
16 throttle part
161 throttle
162 throttle
17 spring
18 passive control valve
181 valve body
182 valve core
183 groove
184 groove
185 extremity
186 spring
187 extremity
188 chamber
19 solenoid valve
20 low pressure circuit
$S_1$ source
P injection pressure
Pi first value of P
$P_2$ second ˆi/alue of P
Pref reference value of P to instant t'o instant ti instant fi instant t'2 instant
$t'_2$ instant
$\delta t_2$ period of time
$\delta t_2$ period of time
$X_1$ longitudinal axis of assembly 1
Xii longitudinal axis of needle 11
Xi2 longitudinal axis of needle 21
$X_{18}$ longitudinal axis of 18 $\alpha$ angle of 212 with respect to Xi $\beta$ angle of 222 with respect to Xi
$Fi_3$ force of spring 13 on needle 12
$F\text{-}_{17}$ force of spring 17 on needle 11
$F\text{-}_{11}$ lift force on needle 11
$F\text{-}_1$2 lift force on needle 12
$F_2$61 force acting on needle 11 as a result of pressure $P_2$61
F262 force acting on needle 11 as a result of pressure $P_2$62
Ln lift of needle 11
$L_1$ value of lift
$L_{12}$ lift of needle 12
$L_2$ value of lift
$P_2$3-$_1$ fuel pressure within chamber 231
P261 fuel pressure within chamber 261
P262 fuel pressure within chamber 262
P188 fuel pressure within chamber 188
I fuel injector
H cylinder head
$FS_1$ first fuel spray
$FS_2$ second fuel spray

The invention claimed is:

1. A nozzle assembly for injecting fuel into a combustion chamber of an engine, the assembly comprising a first needle and a second needle controlling respectively fuel flow towards a first series of outlets and a second series of outlets, a source of fuel under pressure, and a passive control valve, separate from the first needle and the second needle, adapted to select, based on fuel feeding pressure from the source, either one of the first needle and the second needle to be activated for fuel delivery to the combustion chamber.

2. A nozzle assembly according to claim 1, wherein the passive control valve controls a flow of fuel coming from two back-pressure chambers acting on the needles.

3. A nozzle assembly according to claim 2, wherein the passive control valve is adapted to selectively connect, depending on the pressure level of the driving fuel coming from the source, either of the back-pressure chambers with a discharge line.

4. A nozzle assembly according to claim 1, wherein it includes a solenoid valve adapted to pilot one of the needle, depending on the selection made by the passive control valve.

5. A nozzle assembly according to claim 4, wherein the solenoid valve controls the connection between the discharge line and a low pressure circuit.

6. A nozzle assembly according to claim 1, wherein two fuel paths are defined between a source of fuel under pressure and the passive control valve, each path including a back-pressure chamber acting on one of the needles.

7. A nozzle assembly according to claim 6, wherein each fluid path includes at least two throttles located respectively upstream and downstream of the corresponding back-pressure chamber.

8. A nozzle assembly according to claim 6, wherein the throttles are made in at least a part mounted on a body of the assembly which surrounds the needles.

9. A nozzle assembly according to claim 7, wherein one throttle is located between the source of fuel under pressure and each back-pressure chamber.

10. A nozzle assembly according to claim 9, wherein a dedicated throttle is located on the entry line of each back-pressure chamber.

11. A nozzle assembly according to claim 9, wherein a throttle is located on a feeding line common to both back-pressure chambers.

12. A nozzle assembly according to claim 7, wherein one throttle is located between each back-pressure chamber and the passive control valve.

13. A nozzle assembly according to claim 7, wherein one throttle is located downstream of the passive control valve.

14. A nozzle assembly according to claim 1, wherein the outlets series include a first series of outlets distributed around a central axis with a frustroconical configuration having a first angle and a second series of outlets coaxial with the first series, with a frustroconical configuration having a second angle whose value is superior to the value of the first angle.

15. A nozzle assembly according to claim 1, wherein it comprises two back-pressure chambers, each back-pressure chamber acting on one needle.

16. A nozzle assembly according to claim 15, wherein the back-pressure chambers and the needles are coaxial.

17. A nozzle assembly according to claim 1, wherein the passive control valve comprises a valve core movable in translation within a valve body and subject, on one side, to the action of the fuel feeding pressure and, on the other hand to the action of elastic return means.

18. A fuel injector comprising a nozzle assembly according to claim 1.

19. An internal combustion engine comprising at least a cylinder provided with a fuel injector comprising a nozzle assembly according to claim 1.

* * * * *